United States Patent [19]

Quiogue

[11] Patent Number: 4,947,307

[45] Date of Patent: Aug. 7, 1990

[54] ADJUSTABLE RECESSED LOUVERS FOR GRADE MOUNTED LIGHT FIXTURE

[75] Inventor: Honesto D. Quiogue, Florence, Ky.

[73] Assignee: Hubbell Incorporated, Orange, Conn.

[21] Appl. No.: 327,548

[22] Filed: Mar. 23, 1989

[51] Int. Cl.[5] ..... F21V 17/02

[52] U.S. Cl. ..... 362/325; 362/153.1; 362/279; 362/290

[58] Field of Search ..... 362/153, 153.1, 279, 362/282, 290, 32 S, 80 S, 354

[56] References Cited

U.S. PATENT DOCUMENTS

| | | | |
|---|---|---|---|
| 1,868,995 | 7/1932 | Schoen | 362/325 |
| 2,038,506 | 4/1936 | Cadieux | 262/153 |
| 2,587,371 | 2/1952 | Nettesheim | 362/153 X |
| 2,631,247 | 3/1953 | Shaw | 362/276 |
| 2,947,855 | 8/1960 | Schwartz | 362/354 |
| 3,264,466 | 8/1966 | Bacon | 250/215 |
| 3,274,392 | 9/1966 | Harling | 250/239 |
| 3,543,099 | 11/1970 | Turner | 250/226 |
| 3,728,808 | 4/1973 | Rieth | 362/290 X |
| 3,880,528 | 4/1975 | Petersen et al. | 250/239 |
| 4,063,079 | 12/1977 | Feder | 362/290 |
| 4,207,464 | 6/1980 | Fukuyama et al. | 250/239 |
| 4,268,897 | 5/1981 | Schierwagen et al. | 362/290 X |
| 4,343,032 | 8/1982 | Schwartz | 362/802 |
| 4,382,274 | 5/1983 | De Backer | 362/193 |
| 4,630,181 | 12/1986 | Fain et al. | 362/279 X |
| 4,791,290 | 12/1988 | Noone | 250/214 |

OTHER PUBLICATIONS

Imperial Brozelite Brochure, Advanced Grade—Mounted Landscape Lighting, pp. 4–16, 1987.

*Primary Examiner*—Stephen F. Husar

*Attorney, Agent, or Firm*—Jerry M. Presson; Mark S. Bicks

[57] ABSTRACT

A light fixture assembly positionable in a recess in the ground, includes a lamp housing, a light-transparent lens, a lamp and a directional louver assembly. The directional louver assembly is mounted within the lamp housing on annular ledge between the lamp and the lens, and includes a plurality of interconnected rectangular louver members having ends lying on a single circle to form a circular lateral periphery. Rotation of louver assembly on the ledge adjusts the direction of the light emitted from the light fixture.

15 Claims, 2 Drawing Sheets

ADJUSTABLE RECESSED LOUVERS FOR GRADE MOUNTED LIGHT FIXTURE

FIELD OF THE INVENTION

The present invention relates to a directional louver assembly for directing light from a grade-mounted outdoor light fixture. More particularly, the present invention provides a directional louver assembly recessed within the light fixture between its lamp and its lens. The directional louver assembly has a circular lateral periphery permitting infinite directional adjustment.

BACKGROUND OF THE INVENTION

Grade-mounted light fixtures perform a variety of desirable functions, including illuminating walls of buildings, flag poles, trees, shrubs, and signboards. Such light fixtures are grade-mounted because they are installed in recesses in landscapes adjacent to a structure to be illuminated.

Such light fixtures require special consideration in their design and construction. For example, the photocontrol device for automatically controlling actuation of the light fixture must be carefully positioned to insure that the light fixture is turned on and off at the desired times of the day. The electrical wires supplying power to the fixture must also be buried, requiring a trench from the power source to the light fixture and limiting the light fixture to a certain orientation in the recess in the ground. The light fixture orientation dictated by the photocontrol device and/or electrical wires may conflict with the desired alignment of a preset directional louver assembly relative to the structure to be illuminated.

Numerous grade mounted light fixtures are known. However, these known light fixtures have disadvantages. For example, some of these light fixtures do not have louvers or deflectors for directing the light from the light fixture. The known light fixtures with louvers or deflectors to direct the light towards a structure have louvers or deflectors mounted on top of the lens outside the cover, with the louvers being permanently affixed to a square cover. Such outside louvers can be hit by a lawnmower blades, trip pedestrians, and accumulate dirt and debris. The collection of dirt and debris on the louvers reduces the performance of the light fixture and can damage the light fixture by causing it to operate at a hotter temperature, thereby reducing the life of the lamp and the other electrical components.

Light fixtures with directional louvers permanently affixed to a square cover have adjustability limited to 90 degrees. Such limited adjustability makes installation more difficult, since this limited adjustably must also be considered by the installer.

SUMMARY OF THE INVENTION

Accordingly, an object of the present invention is to provide a light fixture with a directional louver assembly mounted within the light fixture housing to avoid being hit by lawnmower blades or passing pedestrians.

A further object of the present invention is to provide a louver assembly for a light fixture that will not accumulate dirt or other debris on the lens of the light fixture.

Another object of the present invention is to provide a louver assembly for a light fixture that is infinitely adjustable in situ.

A further object of the present invention is to provide an inexpensive and rugged directional louver assembly for a light fixture.

The foregoing objects are basically obtained by a directional louver assembly for a light fixture. The directional louver assembly includes a plurality of louver members arranged in a pattern for deflecting light from the light fixture in a desired direction. Each of the louver members has opposite ends substantially located at points on a single circle to define a circular lateral periphery. The louver assembly further includes coupling elements for connecting the louver members together. The circular periphery of the louver members permits rotational adjustment of the louver members within the light fixture to adjust just the direction of the light deflected by the louver members.

The foregoing objects are also obtained by a light fixture comprises a housing, a light-transparent lens, a lamp and a directional louver assembly. The housing has an outer surface with an aperture extending therethrough for receiving the light-transparent lens therein. The lamp is mounted within the lamp housing for directing light through the lens. The directional louver assembly is mounted within the housing between the lens and the lamp for deflecting the light through the lens in a desired direction.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
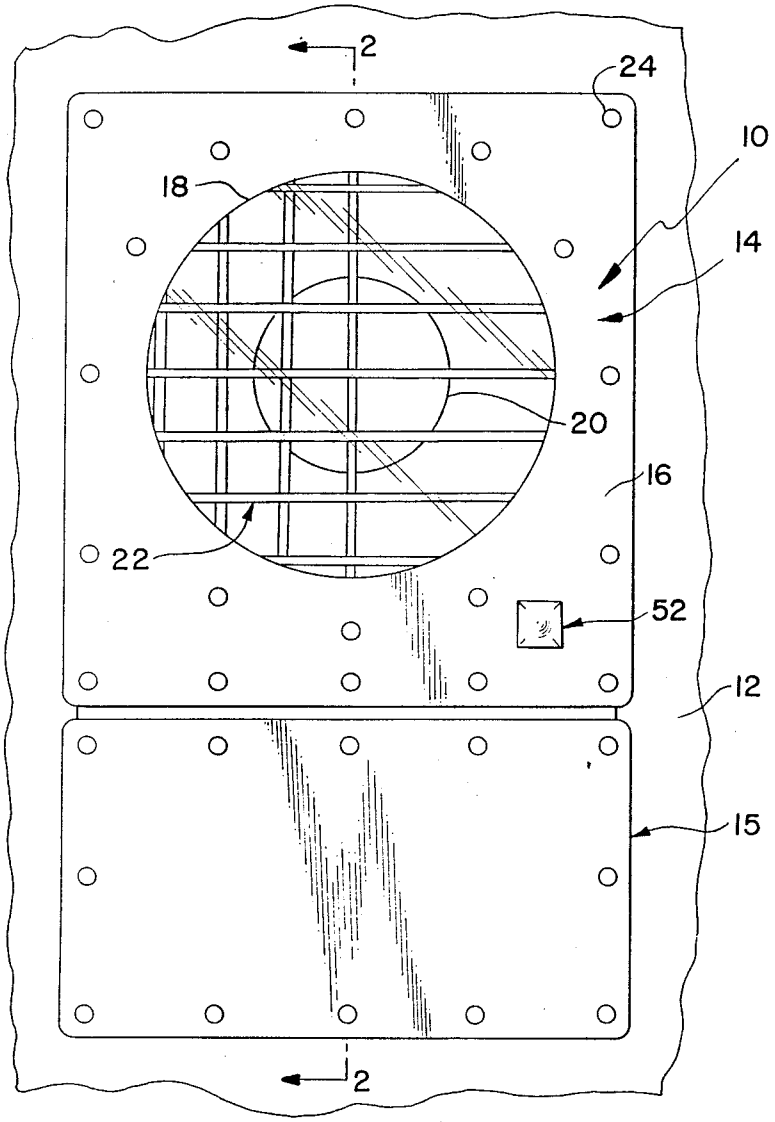
FIG. 1 is a top plan view of a grade mounted light fixture according to the present invention.
Figures 2, 4, 5, 6, 7:
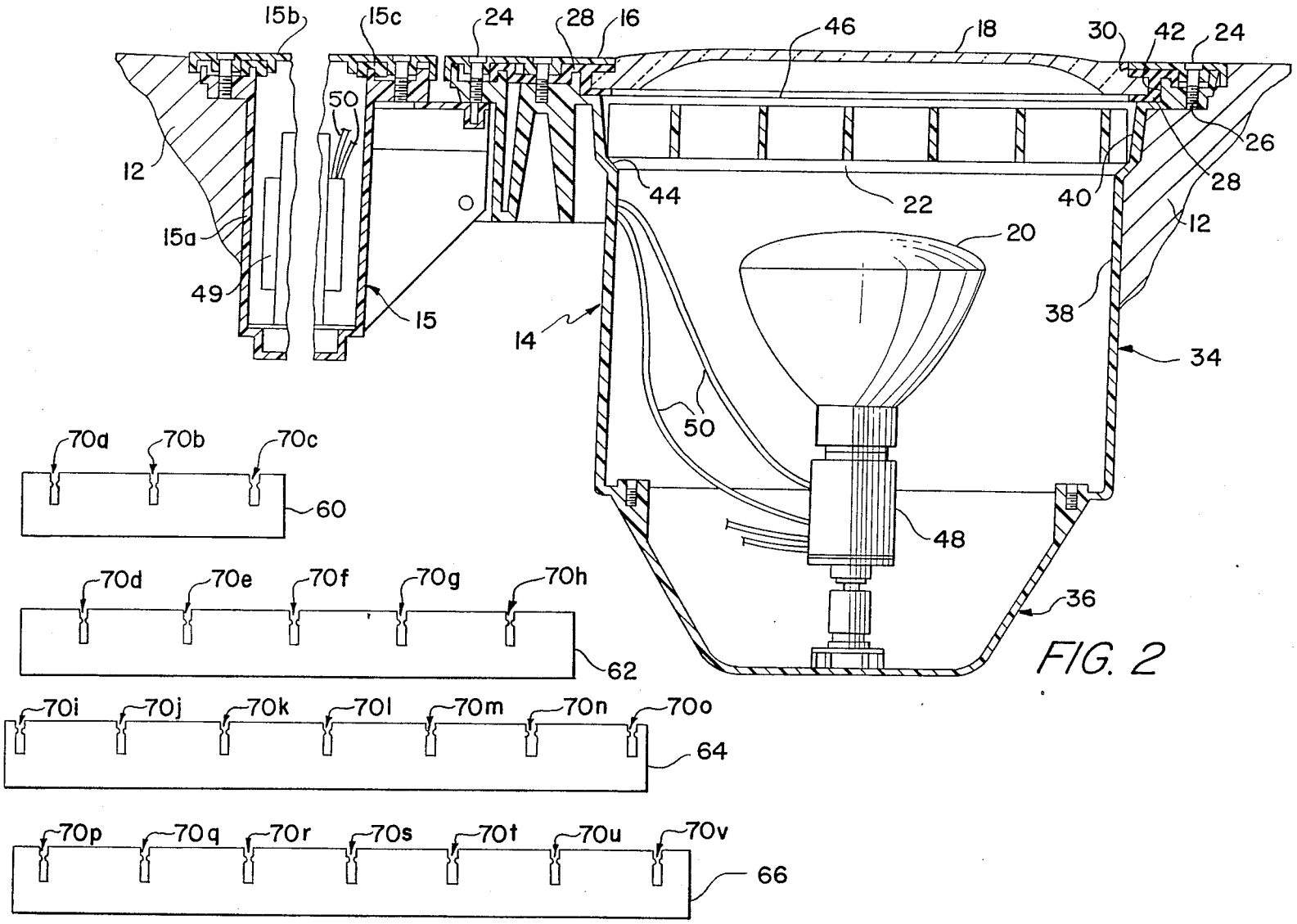
FIG. 2 is a side elevational view in section of the lighting fixture of FIG. 1, taken along line 2—2 of FIG. 1.
FIG. 4 is a side elevational view of a first louver member in accordance with the present invention.
FIG. 5 is a side elevational view of a second louver member in accordance with the present invention.
FIG. 6 is a side elevational view of a third louver member in accordance with the present invention.
FIG. 7 is a side elevational view of a fourth louver member in accordance with the present invention.

Referring initially to FIGS. 1 and 2, a light fixture 10 in accordance with the present invention is located in a graded landscape environment 12. Light fixture 10 includes a lamp housing 14, a ballast housing 15, a cover 16, a light-transparent lens 18, a lamp 20 and a directional louver assembly 22.

As seen in FIG. 2, lamp housing 14 and ballast housing 15 enclose various components of light fixture 10 to form a continuous water-tight barrier between the internal electrical components of light fixture 10 and the surrounding soil of landscape environment 12. Housing 14 and cover 16 are advantageously constructed of a fiberglass-reinforced polyester composite. This material offers desirable strength and high resistance to corrosion, and is light weight for easy installation.

The lamp housing 14 includes a cylindrical lamp support structure 34 which extends downwardly from the top surface of lamp housing 14. Support structure 34 includes a cup shaped base portion 36, a first cylindrical portion 38, a second cylindrical portion 40 and a third cylindrical portion 42.

A first circular or annular ledge 44 is formed between first cylindrical portion 38 and second cylindrical portion 40 for supporting louver assembly 22. Ledge 44 is sufficiently spaced above lamp 20 and below lens 18 and cover 16 to engage and support louver assembly 22 at proper distances from lamp 20 and lens 18.

A second circular ledge 46 is formed between second cylindrical portion and third cylindrical portion. The second ledge 46 supports lens 18, as seen in FIG. 2.

Housing cover 16 is secured to lamp housing 14 by a plurality of threaded stainless steel fasteners 24. The threaded fasteners 24 pass through cover 16 to threadably engage internally threaded holes 26 of lamp housing 14. A gasket 28 is disposed between cover 16 and lamp housing 14 to prevent moisture from penetrating into lamp housing 14.

Gasket 28 is constructed of suitable water resistant material, such as a single piece of molded silicone. The gasket is disposed between transparent lens 18 and cover 16 to seal the aperture 30 against water penetration.

Cover 16 includes an aperture 30 for receiving lens 18. The lens 18 is sealed in aperture 30 by gasket 28 and is positioned to overlie lamp 20 supported inside the lamp housing 14. Light from lamp 20 is transmitted through lens 18 to luminate the outside environment.

Lens 18 is crowned or slightly convex to promote run off of water, dirt and other materials. Lens 18 is advantageously constructed of borosilicate or tempered glass to resist exposure to whether elements, pedestrian traffic, landscape maintenance equipment and other impact and wear forces.

As seen in FIG. 2, a lamp socket 48 is rigidly coupled to base portion 36 for threadably receiving lamp 20. Lamp 20 is supported within the lamp support structure 34, such that light from lamp 20 is directed upwardly through louver assembly 22 and lens 18. The lamp socket 48 is electrically connected to a ballast 49 and a power source (not shown) by wires 50 and electrically connected to a photocontrol 52 by wires.

Ballast housing 15 has a ballast base **15*a* and a cover 15*b*. A gasket 15*c* seals cover 15*b* and housing base 15*a* to prevent moisture from penetrating between cover 15*b* and housing base 15*a*. The ballast housing 15 is separately formed from lamp housing 14 and is coupled to housing 14** by fasteners (not shown).

The photocontrol device 52 operates lamp 20 in response to changes in ambient light conditions. The photocontrol device 52 is more fully described in the copending U.S. Pat. application Ser. No. 176,318 entitled "Photocontrol Device for Grade Mounted Light Fixture" of Honesto D. Quioque, filed Mar. 31, 1988, now U.S. Pat. No. 4,907,139, the subject matter of which is hereby incorporated by reference.

Louver assembly 22 includes a plurality of louver members 60, 62, 64 and 66, individually illustrated in FIGS. 4–7, respectively. The louver members 60, 62, 64 and 66 are rectangular strips or elements. The elements are about 1 inch wide and vary in length.

Figure 3:
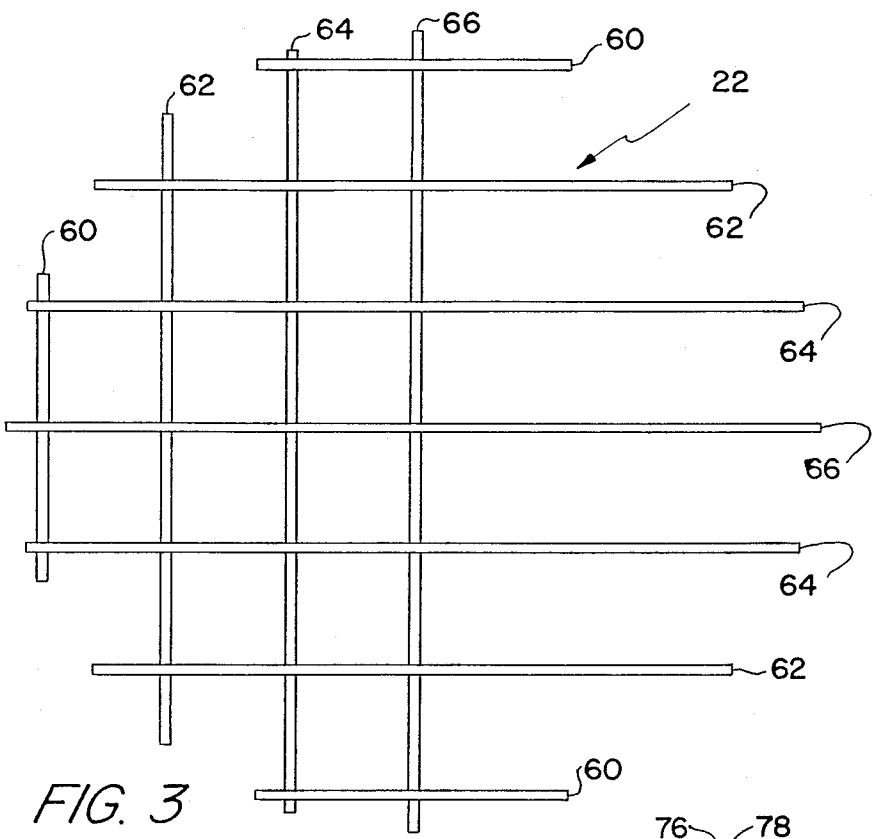
FIG. 3 is a top plan view of a directional louver assembly in accordance with the present invention.

In the embodiment shown in FIGS. 1–3, four different lengths of louver members are utilized. The first louver member 60 is approximately 3.848 inches in length and has three coupling slots **70*a*, 70*b* and 70*c* therein, as seen in FIG. 4. The second louver member 62 is approximately 7.784 inches in length and has five coupling slots 70*d*, 70*e*, 70*f*, 70*g* and 70*h* therein, as seen in FIG. 5. The third louver member 64 is approximately 9.4 inches in length, and has seven coupling slots 70*i*, 70*j*, 70*k*, 70*l*, 70*m*, 70*n* and 70*o* therein, as seen in FIG. 6. The fourth louver member 16 is approximately 9.906 inches in length and has seven coupling slots 70*p*, 70*q*, 70*r*, 70*s*, 70*t*, 70*u* and 70*v* therein, as seen in FIG. 7**.

Figure 8:
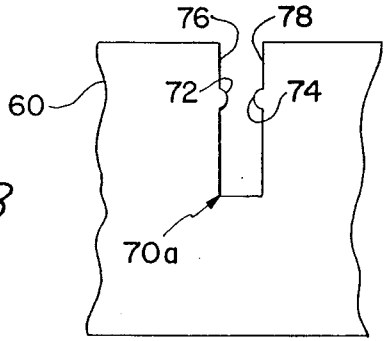
FIG. 8 is an enlarged, partial view of a coupling slot of one of the louver members in accordance with the present invention.

The coupling slots **70*a*–70*v* are all identical, thus only one is described in detail. Referring to FIG. 8, coupling slot 70*a* includes a pair of partially cylindrical projections 72 and 74 that extend inwardly toward one other from its vertical sides 76 and 78, respectively. Coupling slot 70*a* extends inwardly about half the width (0.5 inch) of louver member 60. The width of coupling slot 70*a* from vertical side 76 to vertical side 78 is approximately 0.138 inch, and is about equal to the thickness of each louver member. The projections 72 and 74 have a radius of curvature of 0.062 inch, reducing the width of coupling slot 70*a* to approximately 0.120 inch between the projections 72 and 74**.

Referring to FIG. 3, directional louver assembly 22 includes a first set of louver members arranged perpendicularly to a second set of louver members. The first set of louver members includes a pair of first louver members 60, a pair of second louver members 62, a pair of third louver members 64 and one fourth louver member 66. The second set of louver members includes one louver member 60, one second louver member 62, one third louver member 64 and one fourth louver member 66.

The first and second sets of louver members are coupled together in an egg crate fashion to form louver assembly 22. A coupling slot of one louver member is aligned with a coupling slot of another louver member to frictionally couple the louver members together. Thus, the louver assembly 22 can be assembled without the need of additional fasteners or welding.

The coupling slots **70*a*–70*c* of first louver member 60 (second set) are aligned with coupling slots 70*i* of the pair of third louver members 64 (first set), and coupling slots 70*p* of the fourth louver member 66 (first set). The coupling slots 70*d*–70*h* of second louver member 62 (second set) are aligned with coupling slots 70*d* of the pair of second louver members 62 (first set), coupling slots 70*j* of the pair of third louver members 64 (first set), and coupling slot 70*q* of the fourth louver member 66 (first set). The coupling slots 70*i*–70*o* of third lover member 64 (second set) are aligned with coupling slots 70*a* of the pair of first louver members 60 (first set), coupling slots 70*e* of the pair of second louver member 62 (first set), coupling slots 70*k* of the pair of third louver members 64, and coupling slot 70*r* of the fourth louver member 66 (first set). The coupling slots 70*p*–70*v* of fourth louver member 66 (second set) are aligned with coupling slots 70*b* of the pair of first louver members 60 (first set), coupling slots 70*f* of the pair of second louver members 62 (first set), coupling slots 70*l* of the pair of third louver members 64 (first set), and coupling slot 70*s* of the fourth louver member 66** (first set).

The projections 72 and 74 of each slot frictionally engage the portion of the louver member received in that slot located above the aligned slot in the first set louver members and below the aligned slot in the second set louver members.

As seen in FIG. 2, the louver assembly 22 is supported on first circular ledge 44. As seen in FIG. 3, louver members 60, 62, 64, and 66 have their opposite ends substantially located at points on a single circle to define a circular lateral periphery permitting rotational movement of the louver assembly 22 on first circular ledge 44. Thus, this arrangement permits infinite directional adjustment of light from lamp 20, by rotating louver assembly 22 prior to securing cover 16 and lens 18 to lamp housing 14.

While only one embodiment has been chosen to illustrate the invention, it would be understood by those skilled in the art that various changes and modifications can be made therein without departing from the scope of the invention as defined in the appending claims.

What is claimed is:

1. A directional louver assembly for a light fixture, comprising:

a plurality of louver members arranged in a pattern for deflecting light from the light fixture in a desired direction, said louver members being thin strip-like elements of approximately equal width, each of said louver members having opposite ends substantially located at points on a single circle in a plane to define a circular lateral periphery; and coupling means for connecting said louver members together, said coupling means including a plurality of transverse slots spaced apart along each of said louver members, each of said slots having at least one projection frictionally engaging a portion of one of said louver members received therein;

whereby said circular lateral periphery of said louver members permits rotational adjustment of said louver members about an axis perpendicular to said plane of said circle within the light fixture to adjust the direction of the light deflected by said louver members.

2. A directional louver assembly according to claim 1, wherein one set of said louver members is arranged generally perpendicular to another set of said louver members, both of said sets of louver members being perpendicular to said axis.

3. A directional louver assembly according to claim 1, wherein each of said slots comprises a pair of inwardly facing, opposed projections frictionally engaging a portion of one of said louver members received therein.

4. A directional louver assembly according to claim 1, wherein each of said slots extends approximately half the width of the respective louver member.

5. A grade mounted light fixture, comprising:

a housing having an outer surface with an aperture extending therethrough;

a light-transparent lens coupled to said housing in said aperture and having an optical axis;

a lamp mounted within said housing for directing light through said lens; and a directional louver assembly mounted within said housing between said lens and said lamp for deflecting light through said lens in a desired direction, said louver assembly being rotatably mounted for rotational adjustment about said optical axis within said housing for adjusting the direction of light from said lamp through said lens.

6. A light fixture according to claim 5, wherein said louver assembly comprises a plurality of louver members having opposite ends substantially located at points on a single circle to define a generally circular lateral periphery of said louver assembly in a plane perpendicular to said optical axis.

7. A light fixture according to claim 6, wherein said louver members are thin strip-like elements of approximately equal width.

8. A light fixture according to claim 7, wherein each of said louver members includes a plurality of equally spaced transverse slots.

9. A light fixture according to claim 7, wherein each said slots comprises at least one projection frictionally engaging a portion of one of said louver members received therein.

10. A light fixture according to claim 7, wherein each of said slots comprises a pair of inwardly facing opposed projections frictionally engaging a portion of one of said louver members received therein.

11. A light fixture according to claim 8, wherein each of said louver members has a width; and each of said slots extends approximately half the width of the respective louver member.

12. A light fixture according to claim 5, wherein one set of said louver members is generally perpendicular to another set of said louver members, both of said sets of louver members being perpendicular to said optical axis.

13. A light fixture according to claim 5, wherein said housing comprises an annular ledge located above said lamp and below said lens, said louver assembly being supported on said ledge.

14. A light fixture according to claim 13, wherein said louver assembly is held between said ledge and said lens without additional hardware.

15. A directional louver assembly for a light fixture having an optical axis, comprising:

a plurality of louver members arranged in a pattern for deflecting light from the light fixture in a desired direction and having adjustment means for rotationally adjusting said louver assembly about the optical axis within the light fixture to adjust the direction of light deflected by said louvers, said louver members being thin strip-like elements of approximately equal width, said adjustment means including oppositely ends of each of said louver members substantially located at points on a single circle in a plane substantially perpendicular to the optical axis to define a circular lateral periphery; and coupling means for connecting said louver members together, said coupling means including a plurality of transverse slots spaced apart along each of said louver members, each of said slots having at least one projection frictionally engaging a portion of one of said louver members received therein.

* * * * *